US005107109A

United States Patent [19]

Stafford, Jr. et al.

[11] Patent Number: 5,107,109

[45] Date of Patent: Apr. 21, 1992

[54] METHOD OF INCREASING THE DYNAMIC RANGE AND SENSITIVITY OF A QUADRUPOLE ION TRAP MASS SPECTROMETER

[75] Inventors: George C. Stafford, Jr.; Dennis M. Taylor, both of San Jose; Stephen C. Bradshaw, Watsonville, all of Calif.

[73] Assignee: Finnigan Corporation, San Jose, Calif.

[21] Appl. No.: 837,702

[22] Filed: Mar. 7, 1986

[51] Int. Cl.[5] ..... H01J 49/42

[52] U.S. Cl. ..... 250/282; 250/291; 250/292

[58] Field of Search ..... 250/281, 282, 290, 291, 250/292, 423 R, 424, 427

[56] References Cited

U.S. PATENT DOCUMENTS

| | | | |
|---|---|---|---|
| 3,502,867 | 3/1970 | Beauchamp | 250/291 |
| 3,937,955 | 2/1976 | Comisarow et al. | 250/281 |
| 4,105,917 | 8/1978 | McIver et al. | 250/291 |
| 4,464,570 | 8/1984 | Allemann et al. | 250/291 |
| 4,535,235 | 8/1985 | McIver | 250/282 |
| 4,540,884 | 9/1985 | Stafford et al. | 250/282 |

*Primary Examiner*—Jack I. Berman

*Attorney, Agent, or Firm*—Flehr, Hohbach, Test, Albritton & Herbert

[57] ABSTRACT

An improved method of mass analyzing a sample in a three-dimensional quadruple ion trap with varying fields is disclosed. The dynamic range and sensitivity of previous methods is increased by controlling the number of sample ions formed in the ion trap to avoid saturation and space charge.

5 Claims, 8 Drawing Sheets

METHOD OF INCREASING THE DYNAMIC RANGE AND SENSITIVITY OF A QUADRUPOLE ION TRAP MASS SPECTROMETER

The present invention is directed to a method of increasing the dynamic range and sensitivity of a quadrupole ion trap mass spectrometer.

An ion trap mass spectrometer is described in the Paul et al U.S. Pat. No. 2,939,952 dated June 7, 1960. Actually in broader terms it is termed a quadrupole ion store. In general, a hyperbolic electric field provides an ion storage region by the use of either a hyperbolic electrode structure or a spherical electrode structure which provides an equivalent hyperbolic trapping field. Ion trap mass spectrometers are also described in Dawson et al, U.S. Pat. No. 3,527,939; McIver U.S. Pat. No. 3,742,212; McIver et al U.S. Pat. No. 4,104,917 and Stafford et al U.S. Pat. No. 4,540,884.

In such mass spectrometers, mass storage is achieved by operating the trap electrodes with values of RF voltage, V, frequency, f, d.c. voltage, U, and device size, $r_o$ such that ions within a range of mass to charge ratio values are stably trapped within the device. These parameters will be referred to as scanning parameters and have a fixed relationship to the trapped masses. For stable ions there exists a distinctive frequency for each value of charge to mass. For detection of the ions these frequencies can be determined by a frequency tuned circuit which couples to the oscillating motion of the ions within the trap, and then by use of analyzing techniques mass to charge ratio may The other mode of operation, the ion storage mode, relates more to typical MS techniques where, in the Mathieu curves, a designated normal scanning line selects ions of only one mass at a time. That is, the other ions are unstable and untrappable. Then a voltage pulse is applied between the end caps and the trapped stable ions are ejected out of the storage region to a detector. To select a given charge to mass ratio the appropriate voltages, V, U and frequency (f) must be applied In U.S. Pat. No. 4,540,884 there is described a method of mass analyzing a sample which comprises the steps of ionizing the sample to form ions indicative of the sample constituents. The ions in the mass range of interest are temporarily trapped in an ion storage apparatus by application of suitable d.c. and RF voltages to electrodes that provide a substantially hyperbolic electric field within the ion storage apparatus. The amplitude of the applied voltages are then varied between predetermined limits. Ions of specific mass to charge ratios become sequentially and selectively unstable and exit from the ion trap. The unstable ions are detected as they exit the ion trap, and the ions are identified by the scanning parameters at which they become unstable.

When operating a mass spectrometer in connection with a gas chromatograph the concentration of the sample which enters the ion trap for ionization and analysis varies. In the prior art the ionization times have remained relatively constant. Thus, at the higher concentrations of sample there is saturation and space charge effects which result in the loss of mass resolution and sensitivity and errors in mass assignment.

It is an object of the present invention to provide an improved method of operation for quadrupole ion trap mass spectrometers.

It is another object of the present invention to provide a method of operation of an ion trap mass spectrometer with increased dynamic range and sensitivity for detection of ions over a wide mass range.

It is a further object of the present invention to provide an ion trap mass spectrometer in which the ionization time is controlled to control the number of ions formed thus avoiding saturation and space charging resulting in increased resolution and sensitivity over an increased dynamic sample concentration or pressure range.

In accordance with the above objects, there is provided a method of mass analyzing a sample in a quadrupole ion trap mass spectrometer in which the number of sample ions formed in the ion trap is controlled to avoid saturation and space charge.

The foregoing and other objects will be more clearly understood from the following description and accompanying drawings, of which:

Figure 1:
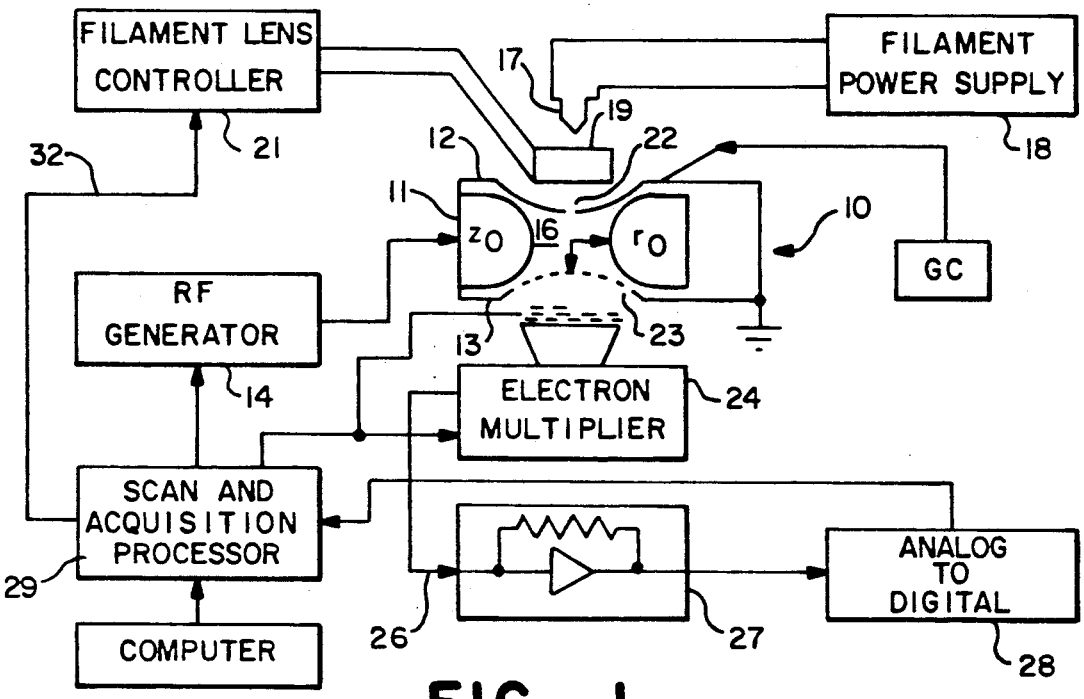
FIG. 1 is a simplified schematic of a quadrupole ion trap mass spectrometer embodying the present invention including a block diagram of the associated electrical circuitry.

Referring first to FIG. 1, a three dimensional ion trap is shown at 10. The ion trap includes a ring electrode 11, and two end caps 12 and 13 facing one another. A radio frequency (RF) voltage generator 14 is connected to the ring electrode 11 to supply a radio frequency (RF) voltage V sin $\omega t$ between the grounded end caps and the ring electrode. The voltage provides the quadrupole electric field for trapping ions within the ion storage region or volume 16. The storage region has a vertical dimension $z_o$ and a radius $r_o$.

Figure 3:
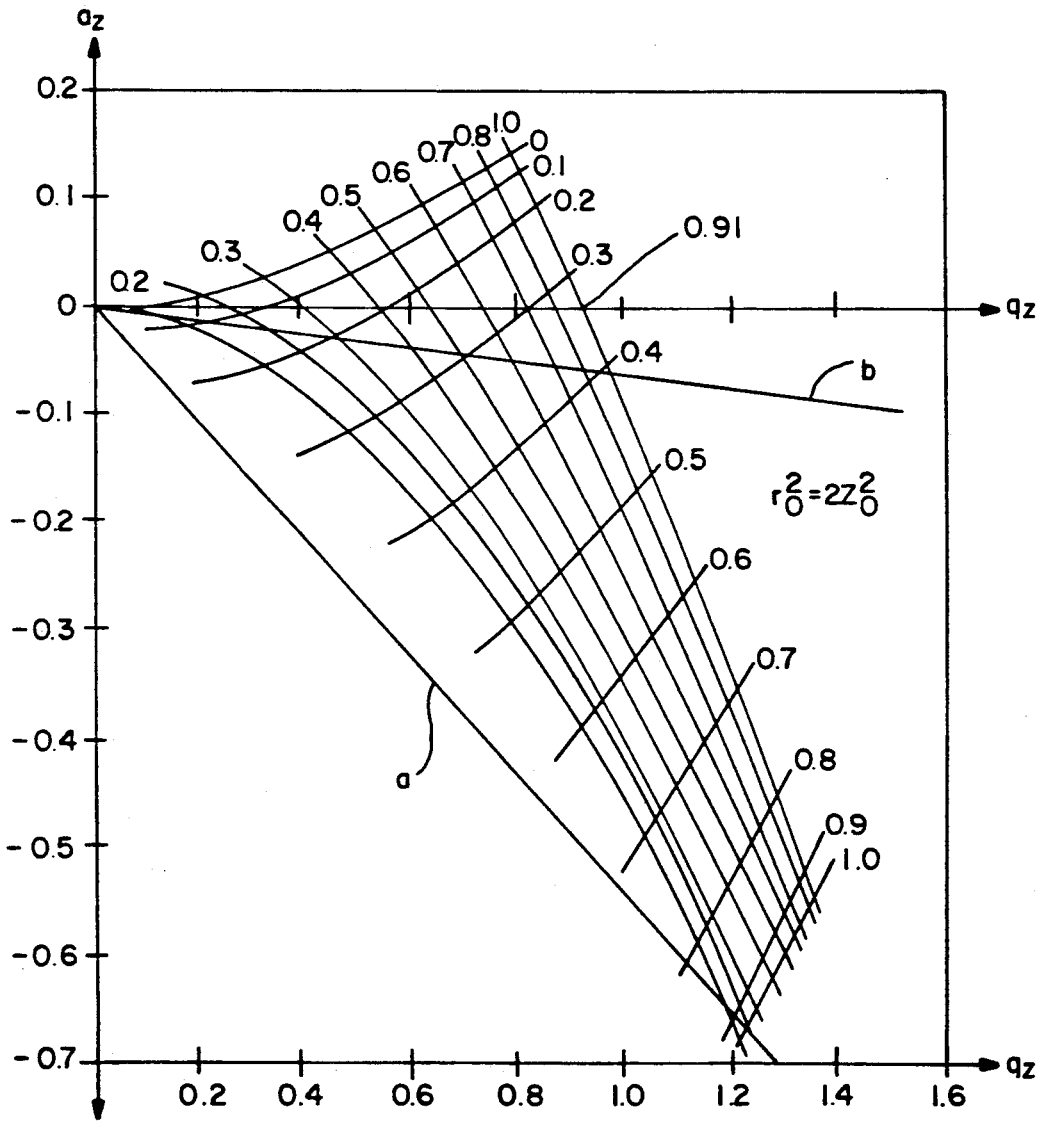
FIG. 3 is a stability envelope for a quadrupole ion trap of the type shown in FIG. 1.

The symmetric fields in the ion trap 10 lead to the stability diagram shown in FIG. 3. The ion masses that can be trapped depends on the numerical values of the scanning parameters. The relationship of the scanning parameters to the mass to charge ratio of the ions that are trapped is described in terms of the parameters "a" and "q" in FIG. 3.

These parameters are defined as:

$$a_z = \frac{-8eU}{mr_o^2\omega^2}$$

$$q_z = \frac{reV}{mr_o^2\omega^2}$$

where

V=magnitude of radio frequency (RF) voltage

U=amplitude of applied direct current (d.c.) voltage e=charge on charged particle m=mass of charged particle $r_o$=distance of ring electrode from center of a three dimensional quadrupole electrode structure symmetry axis $z_o=r_o/\sqrt{2}$ $\omega=2\pi f$ f=frequency of RF voltage FIG. 3 shows that for any particular ion, the values of a and q must be within the stability envelope if it is to be trapped within the quadrupole fields of the ion trap device.

The type of trajectory a charged particle has in a three dimensional quadrupole field depends on how the specific mass to charge ratio, m/e, of the particle and the applied field parameters, U, V, $r_o$ and $\omega$ combine to map onto the stability diagram. If these scanning parameters combine to map inside the stability envelope then the given particle has a stable trajectory in the defined field. A charged particle having a stable trajectory in a three dimensional quadrupole field is constrained to an aperiodic orbit about the center of the field. Such particles can be thought of as trapped by the field. If for a particle m/e, U, V, $r_o$ and $\omega$ combine to map outside the stability envelope on the stability diagram, then the given particle has an unstable trajectory in the defined field. Particles having unstable trajectories in a three dimensional quadrupole field attain displacements from the center of the field which approach infinity over time. Such particles can be thought of as escaping the field and are consequently considered untrappable.

For a three dimensional quadrupole field defined by U, V, $r_o$ and $\omega$ the locus of all possible mass to charge ratios maps onto the stability diagram as a single straight line running through the origin with a slope equal to $-2U/V$. This locus is also referred to as the scan line. That portion of the locus of all possible mass to charge ratios that maps within the stability region defines the range of charge to mass ratios particles may have if they are to be trapped in the applied field. By properly choosing the magnitudes of U and V, the range of specific masses of trappable particles can be selected. If the ratio of U to V is chosen so that the locus of possible specific masses maps through an apex of the stability region, line a, then only particles within a very narrow range of specific masses will have stable trajectories. However, if the ratio of U to V is chosen so that the locus of possible specific masses maps through the middle of the stability region, line b, then particles of a broad range of specific masses will have stable trajectories.

The present mass spectrometer operates as a mass spectrometer based on mass selective instability, rather than mass selective detection as in Paul's resonance technique or mass selective storage. In general terms the method is as follows: DC and RF voltages (U and V cos $\omega t$) are applied to a three-dimensional electrode structure such that ions over the entire specific mass range of interest are simultaneously trapped within the field imposed by the electrodes. Ions are then created or introduced into the quadrupole field area by any one of a variety of well known techniques. After this storage period, the DC voltage, U, the RF voltage V, and the RF frequency, $\omega$, are changed, either in combination or singly so that trapped ions of consecutive specific masses become successively unstable. As each trapped ionic species becomes unstable, all such ions develop trajectories that exceed the boundaries of the trapping field. These ions pass out of the trapping field through perforations in the field imposing electrode structure and impinge on a detector such as an electron multiplier 24 or a Faraday collector. The detected ion current signal intensity as a function of time corresponds to a mass spectra of the ions that were initially trapped.

Referring back to FIG. 1, to provide an ionizing electron beam for ionizing the sample molecules which are introduced into the ion storage region 16, there is a filament 17 which may be Rhenium, which is fed by a filament power supply 18. The filament is on at all times. A cylindrical gate electrode and lens 19 is powered by a filament lens controller 21. The gate electrode provides control to gate the electron beam on and off as desired. End cap 12 includes an electron beam aperture 22 through which the beam projects. The opposite end cap 13 is perforated as illustrated at 23 to allow ions which are unstable in the fields of the ion trap to exit and be detected by an electron multiplier 24 which generates an ion signal on line 26. The signal on line 26 is converted from current to voltage by an electrometer 27. An analog to digital converter unit 28 provides digital signals to the scan and acquisition processor 29. The scan and acquisition processor 29 is connected to the RF generator 14 to allow the magnitude or frequency of the RF voltage to be varied. This provides, as will be described below, for mass selection. The scan and acquisition processor 29 gates the filament lens controller 21 which applies voltage to the gate control electrode 19 to allow the ionizing electron beam to enter the trap only at time periods other than the scanning interval.

If the filament biasing voltage applied by the filament power supply 18 is such that electrons emitted from the filament have sufficient energy to ionize materials (i.e., above the ionization potential of materials, which is from 12.6 volts for methane to 24.5 volts for helium) then ionization will take place within the trap during the ionization pulse, but also will take place outside the trap at all times. Ions formed outside the trap will find their way to the multiplier 24 and produce unwanted signals, or noise.

However, if the electron energy is lowered below the ionization energy of methane, say 12.5 volts, then ionization of atoms or molecules will not take place outside the trap. However, electrons accelerated into the trap will gain energy from both the accelerating pulse voltage on the control electrode 19 and the RF field, and become energetic enough to ionize materials within the trap.

Figure 2:
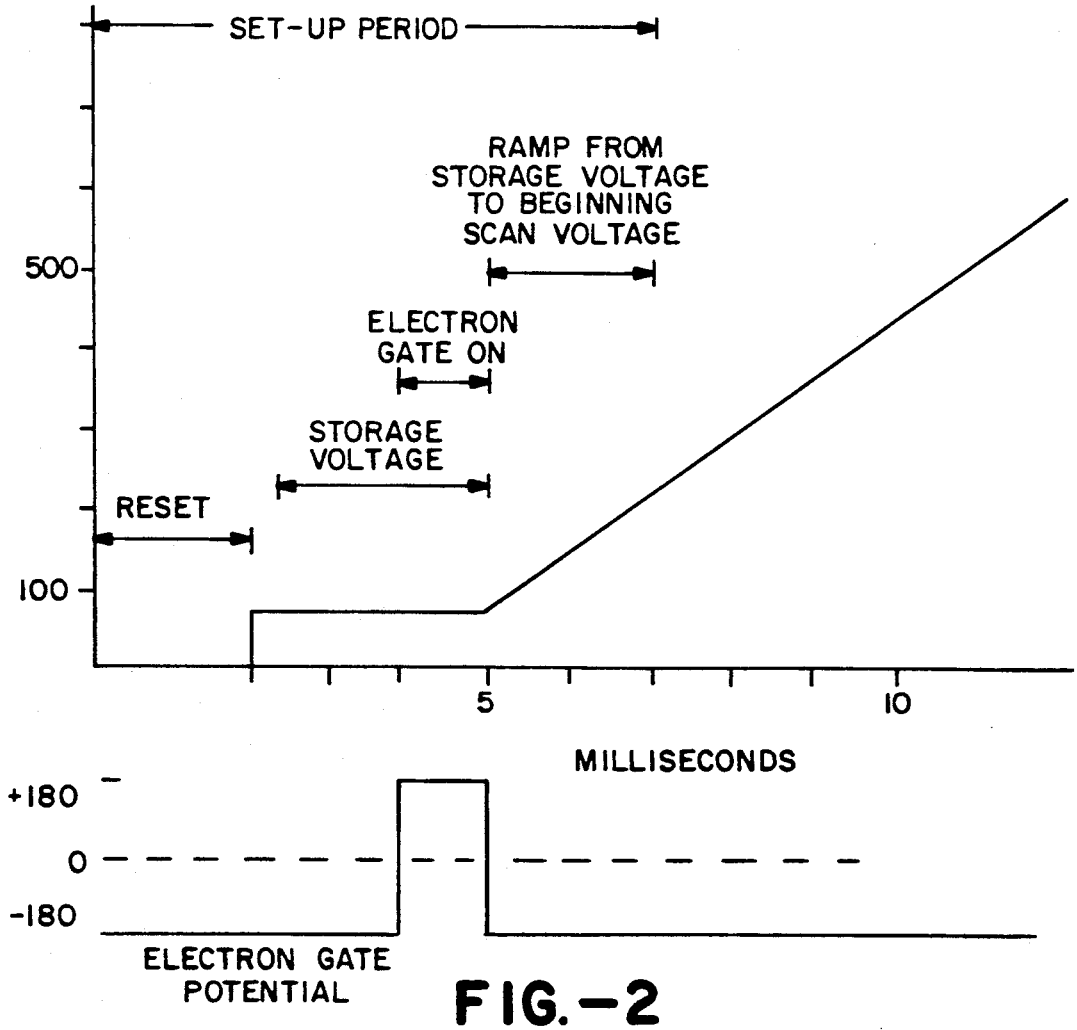
FIG. 2 shows timing diagrams illustrating the operation of the ion trap as a scanning mass spectrometer.

The ion trap, filament, electron multiplier and control electrode are operated under vacuum. The optimum pressure range of operation is about $1\times10^{-3}$ torr of suitable gas within the ion storage region and exterior thereto about $1\times10^{-4}$ torr. The three electrode structure of the ion trap is first operated at zero or very low RF voltage to clear the trap of all ions, a trapping RF voltage is then applied and when the field is established the gating electrode is gated on to allow electrons to enter the trap and ionize the sample material where they receive energy from the RF field. All the ions which have a q on the stability diagram below about 0.91 are stored. Following this the RF field is ramped to a beginning scan voltage. The ramp rate is then changed and the trapped ions are sequentially expelled by the increasing RF voltage. The foregoing sequence of operation is shown in FIG. 2.

The electrons collide and ionize neutral molecules residing in the trapping field region. After some time interval the electron beam is turned off and ionization within the trapping field ceases. Ion species created in the trapping field region whose specific masses are less than the cut-off specific mass for the trapping field very quickly (within a few hundreds of field cycles) collide with the field imposing electrodes or otherwise depart from the trapping field region. Ions created in the trapping field that have specific masses above the cut-off specific mass but which have trajectories which are so large as to cause them to impinge on the field imposing electrodes or otherwise leave the field region typically do so in a few hundred field cycles. Therefore several hundred field cycles after termination of ionization few stable or unstable ions are leaving the trapping field and striking the detector 24 behind the lower end cap 13. However, there still remains a significant number of ions contained in the trapping field.

Following the ionization period the magnitude of the trapping field potential is ramped. As the applied RF voltage V increases, stored ions become sequentially unstable in order of increasing specific mass. Ions that become sequentially unstable during this voltage change do so primarily in the axial direction of motion This means that as trapped ions attain instability because of the changing trapping field intensity, they rapidly depart the trapping field region in the direction of one or the other end cap electrodes. Since the lower end cap electrode in the device shown in FIG. 1 is perforated, a significant percentage of unstable ions transmit through this electrode and strike the detector 24. If the sweep rate of the RF voltage is chosen so that ions of consecutive specific masses are not made unstable at a rate faster than the rate at which unstable ions depart the trapping field region, the time intensity profile of the signal detected at the electron multiplier will correspond to a mass spectrum of the ions originally stored within the trapping field.

When the sample concentration or pressure is high, the ionization may cause saturation or space charge. In accordance with the present invention the number of ions formed is controlled to minimize saturation and space charge. The number of ions formed can be controlled by controlling the ionization time, by controlling the ionization current or by controlling the ion trap fields. In accordance with the preferred embodiment the ionization time is reduced as the sample concentration increases. To illustrate ionization times were switched to reduce the ionization time over a broad range as the concentration of sample increased to control the number of ions formed. This resulted in optimization of the sensitivity and avoided saturation and space charge effects which would have caused a loss of mass resolution and mass assignment errors. The experiments were carried out with a test mixture containing benzophenone, methyl stearate and pyrene at a concentration of 500 ng per microliter. The solution was successively diluted with hexane down to 100 pg per microliter. The solution was analyzed using a 15 meter wide bore DB-5 chromatographic column with an open splitter adjusted for slightly positive vent flow at the final column temperature. The gas chromatograph conditions were:

| | | |
|---|---|---|
| | Injector = | 270° C. |
| Column: | Initial Temperature = | 75° C. |
| | Initial Time = | 1 min. |
| | Ramp Rate = | 30° C./min. |
| | Final Temperature = | 280° C. |
| | Final Time = | 3 min. |
| | Total Run Time = | 10 min. |
| | Transfer Line Temperature = | 260° C. |
| | Grob (splitless) | |
| | Injection Time = | 1 min. |
| | Injector Split Flow = | 30 ml/min. |
| | Linear Velocity = | 22 cm/sec. |

In order to provide a comparison a base line analysis was performed using standard ion times and emission currents in a four segment scan as described in copending application Ser. No. 454,551.

Figure 4:
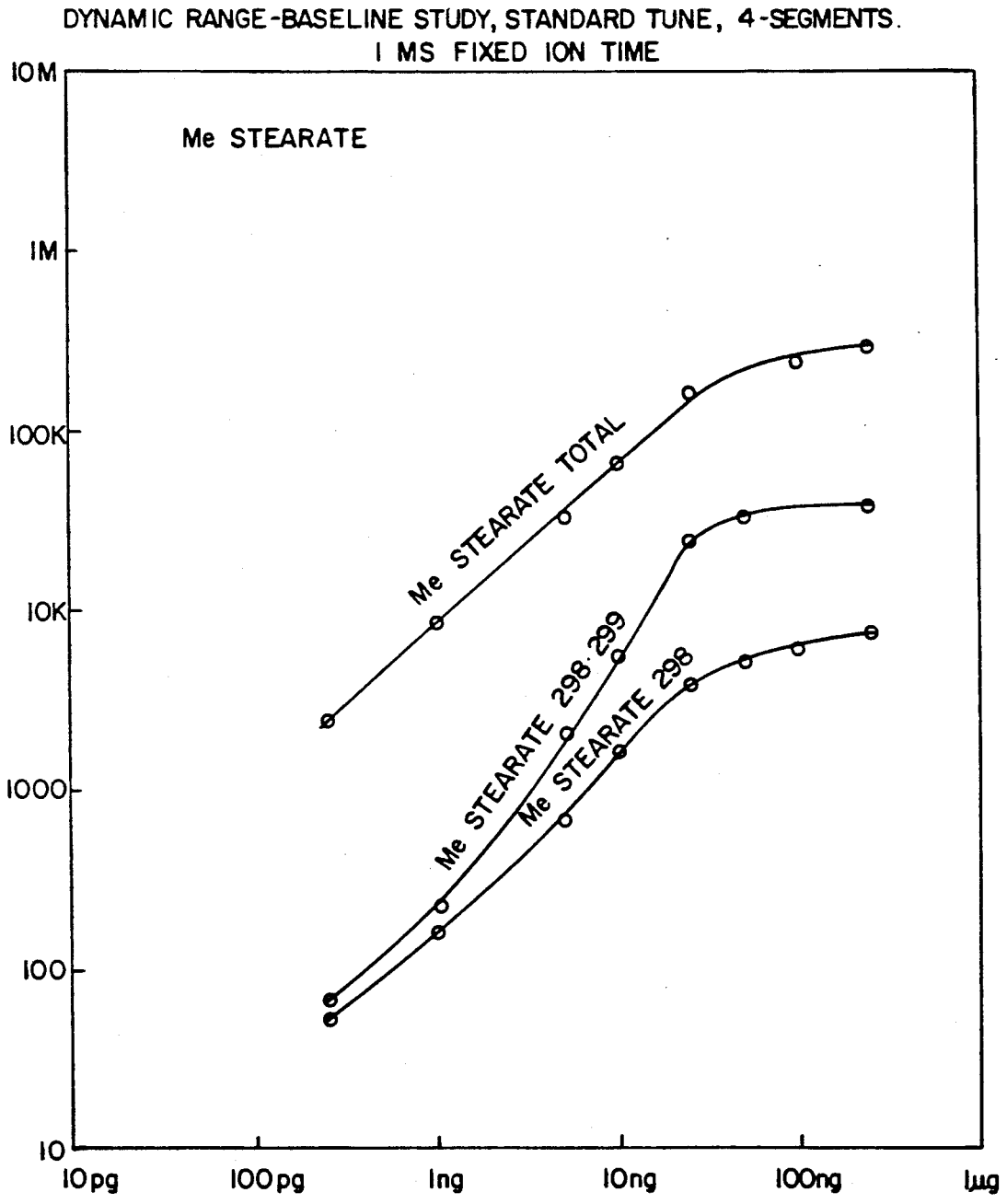
FIGS. 4–6 show the dynamic range and sensitivity of an ion trap scanning mass spectrometer operated in accordance with the prior art for selected samples.
Figure 5:
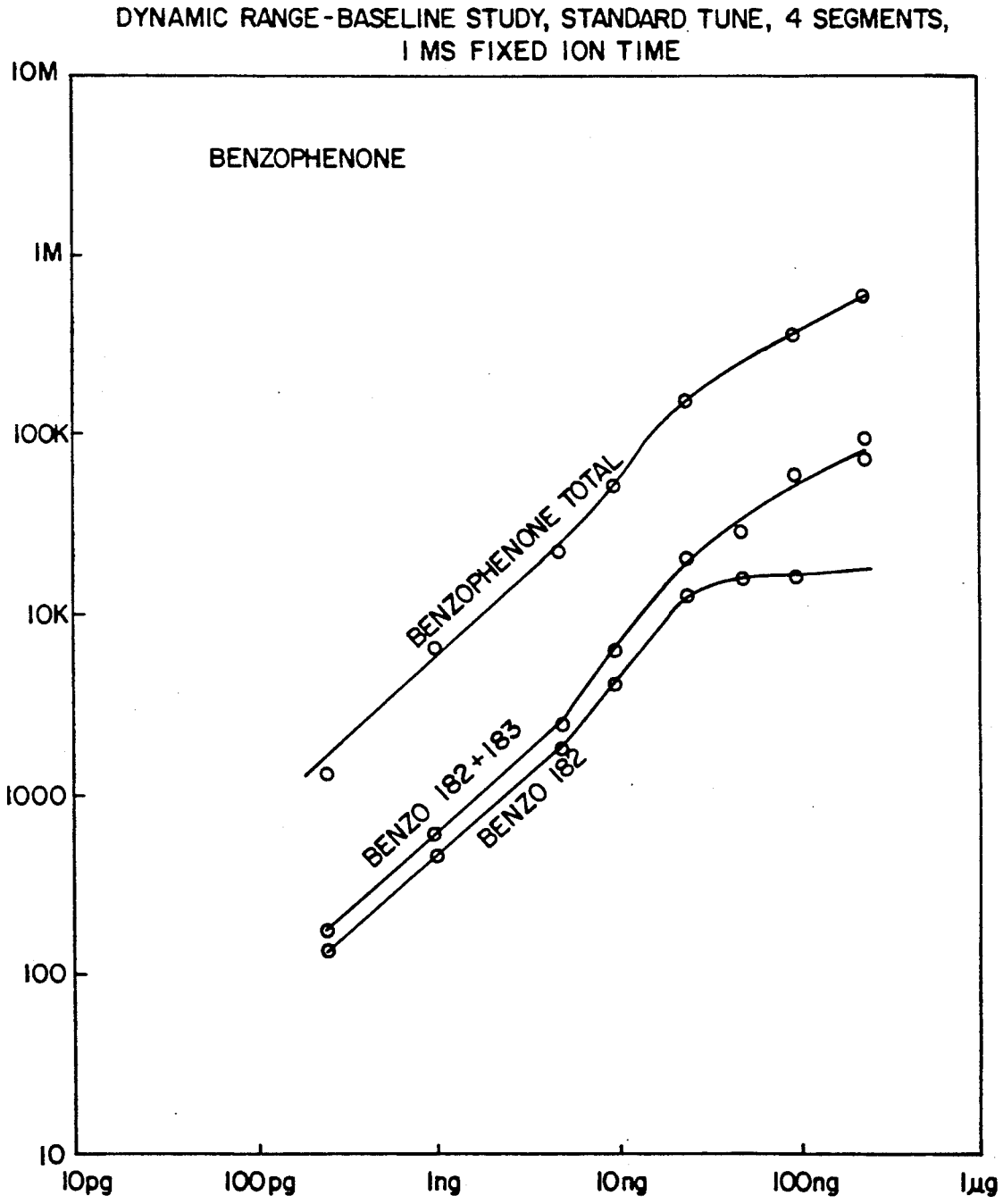
Figure 6:
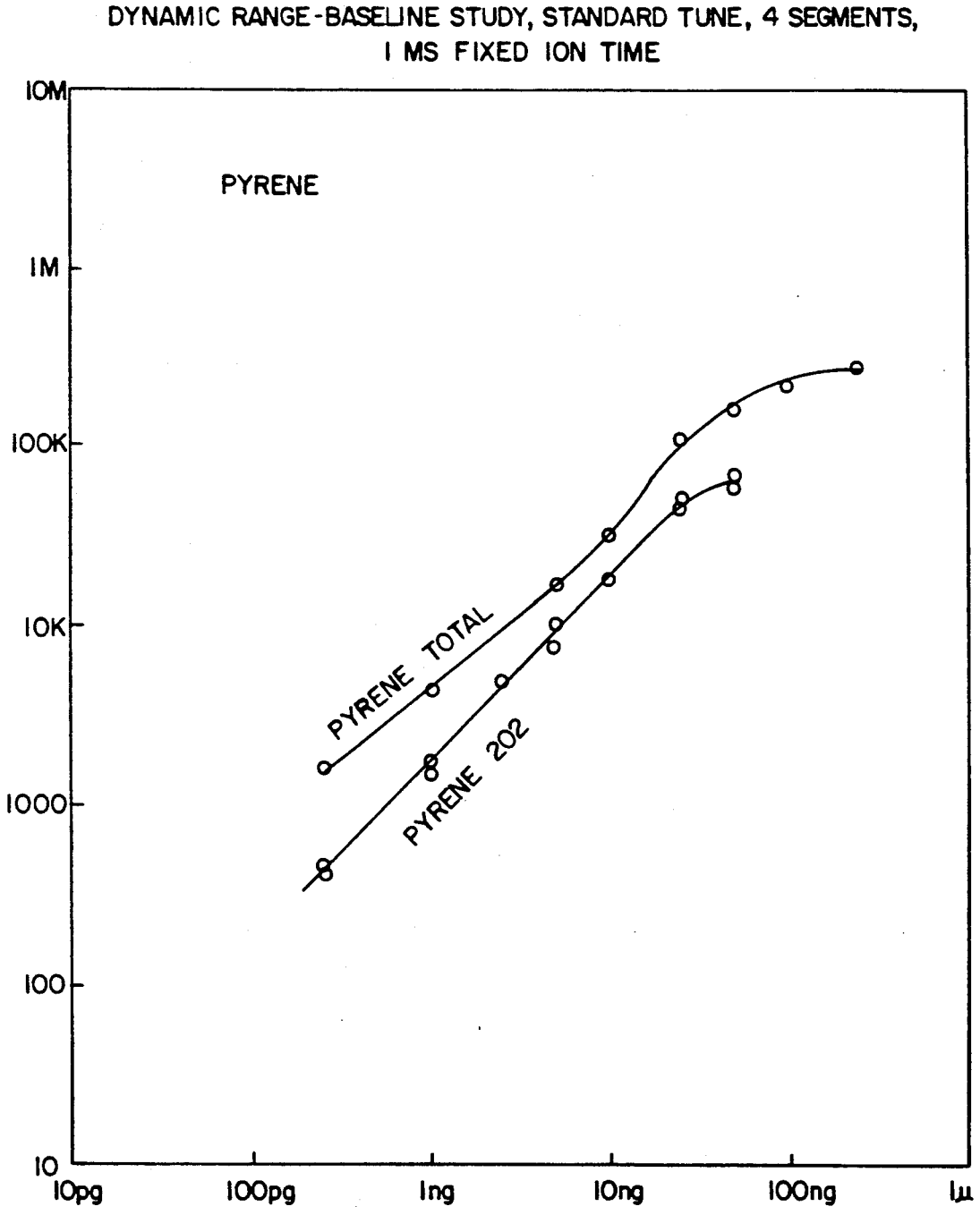

The baseline performance data curves for the three compounds are shown in FIGS. 4–6. Concentration ranges of 250 pg to 250 ng are shown on the x axis. The area under the corresponding mass peaks is plotted in arbitrary units on the y axis. It is noted that the curves begin to flatten at a concentration of 25 ng. Methyl stearate is the worst performer, flattening at the lowest concentration. The spectra for each compound can be examined to reveal evidence of saturation at 25 ng and above. The pyrene spectra show little change until the 50 ng level where saturation of the ion trap causes a mass assignment error and mass 202 appears as mass 204 Pyrene, therefore, has a dynamic range of less than 100. Methyl stearate shows the most significant spectral changes with concentration. The M+1 ion at 299 dominates the spectrum at 25 ng and the adjacent masses reveal saturation effects at 50 ng and above. Only mass 300 appears due to mass-assignment errors. The curves clearly show that the dynamic range and sensitivity reduces as the ion concentration approaches saturation and space charge limiting.

For the variable ionization time data the ionization times were manually set and measured at five different values, each a factor of four apart. A single segment scanning technique was used and the filament was operated with an emission current of 5 ua. Data was obtained at five different ion times: 0.1 ms, 0.4 ms, 1.6 ms, 6.4 ms and 25.6 ms, representing a total range of 256.

Figure 7:
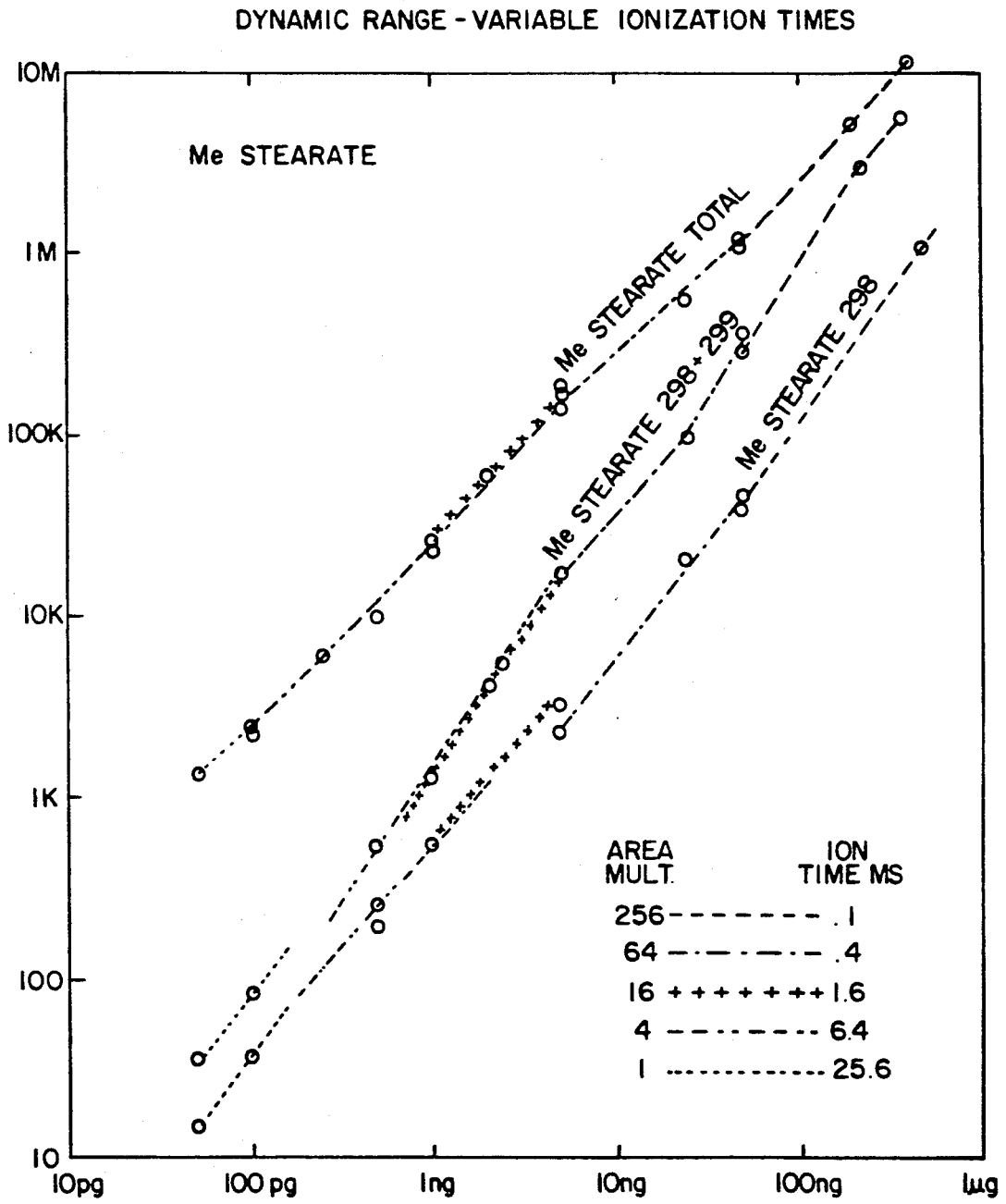
FIGS. 7–9 show the dynamic range and sensitivity of an ion trap mass spectrometer operated in accordance with the present invention for the same samples.
Figure 8:
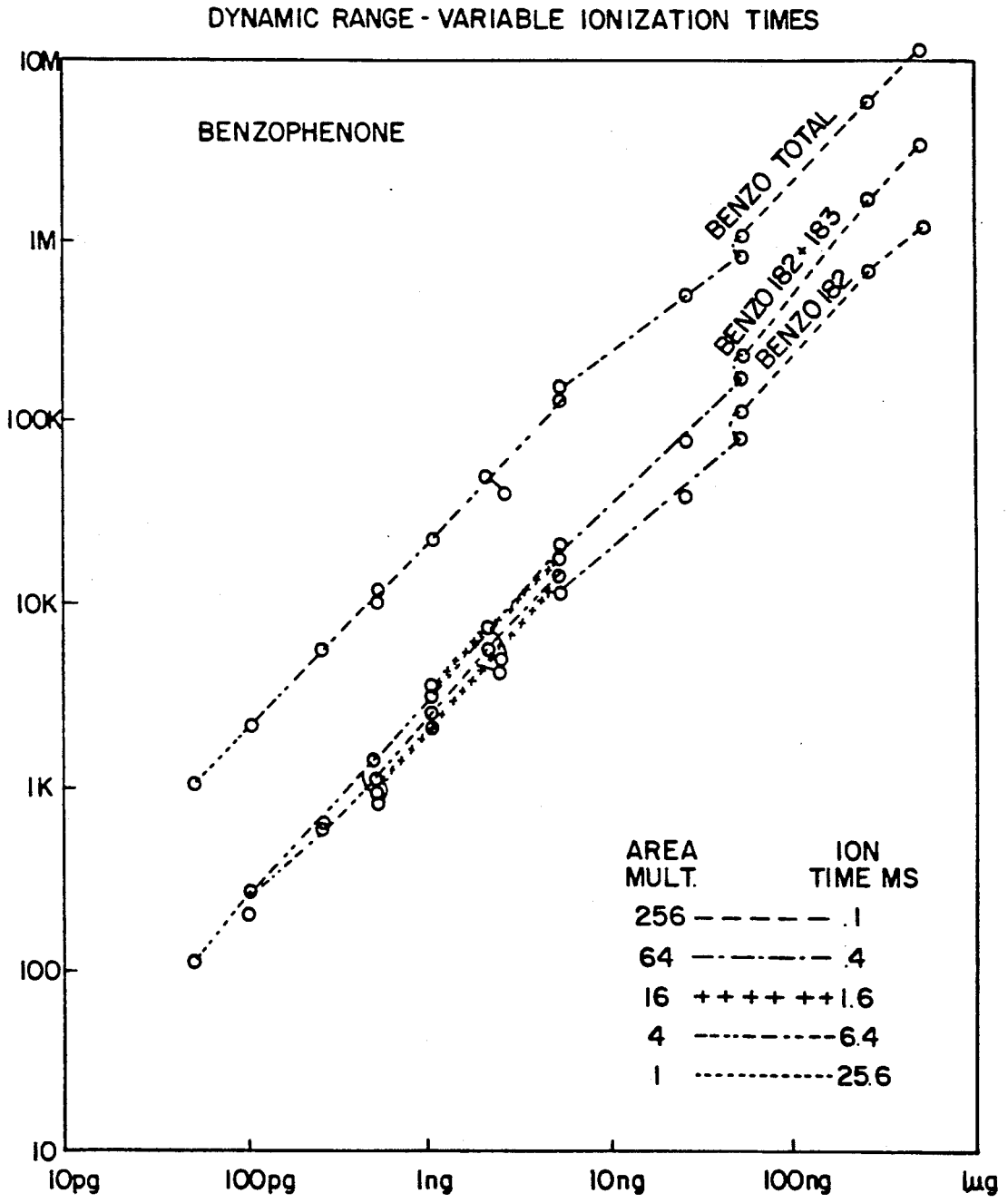
Figure 9:
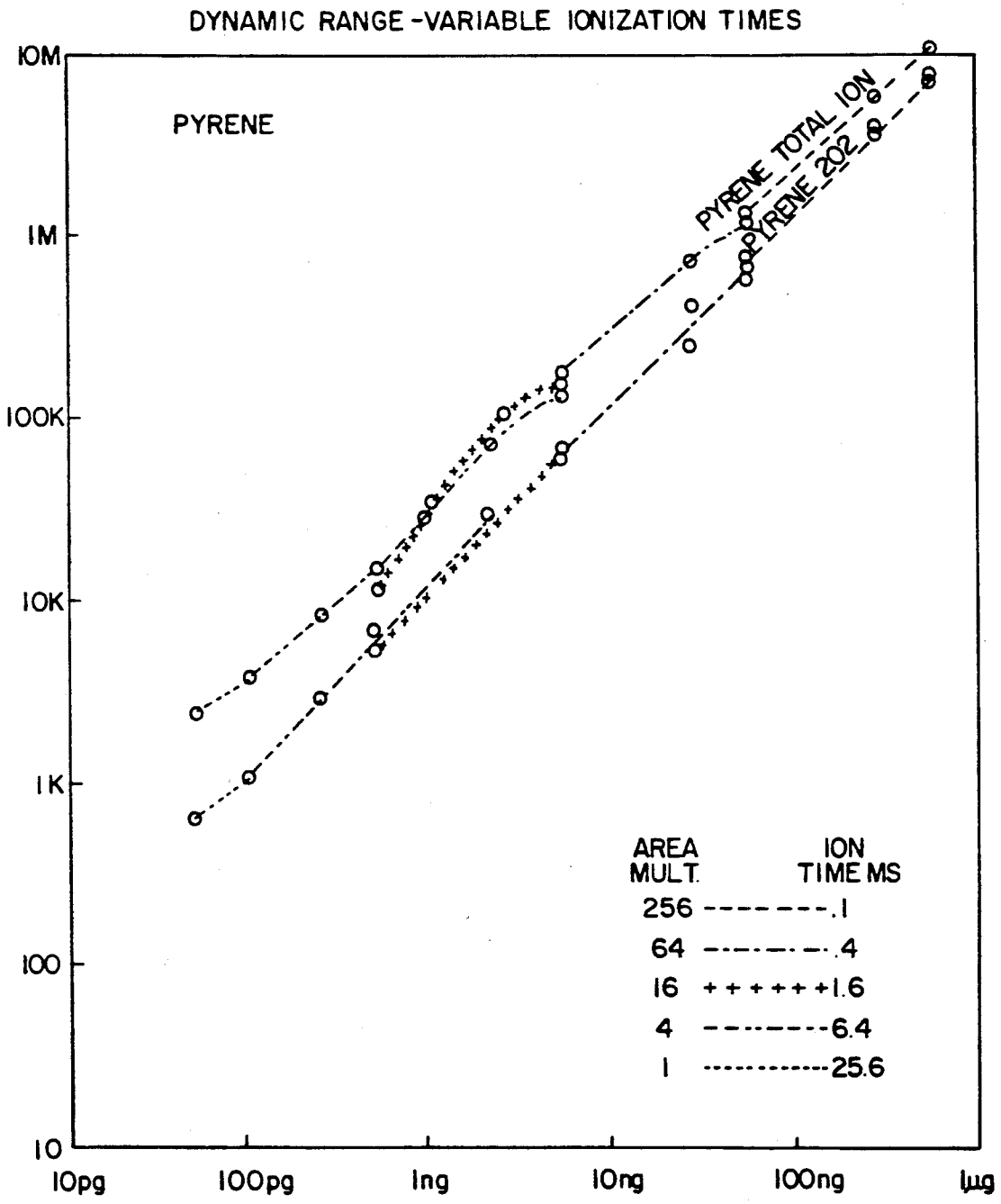

In FIGS. 7–9, the peak data obtained at the five ionization timed settings is shown. The data is plotted end to end for each of the compounds. The data was obtained in the linear portion of the dynamic range. The data was multiplied by an area factor which placed all the data on a comparable basis. Examination of the curves 7–9 shows a dynamic range of up to $10^4$ was obtained. It is noted that detection limits are enhanced over the baseline performance by a factor of 2 by using the longest ion times.

The ionization time can be automatically controlled by making a rapid measurement of the total ion content of the ion trap just prior to performing a scan. This could be achieved by ionizing for a short time period prior to a scan, say one hundred microseconds, and integrating the total ion content in the processor 29. The computer would be programmed with an algorithm such that, with the total ion content input, it would then select an appropriate ionization time before each scanning cycle during data acquisition.

In the above example the three-dimensional ion trap electrodes were driven with a purely RF voltage, and the magnitude of that voltage was changed However, the basis technique claimed applies equally well to situation where there is an applied d.c. voltage, U, in addition to the RF voltage, V, between the ring electrode and the end cap electrodes. Such operation would just place an upper limit on the range of specific masses that may be mass analyzed in a given experiment. While maintaining a constant ratio between the applied RF and d.c. potentials (U and V) is convenient, in that the magnitudes of the voltages relate linearly to the specific mass of the detected ions, it is not inherent in the technique. While changing one or both of the applied d.c. and RF voltages to mass sequentially destablize ions is easy to implement, there is no theoretical reason why one shouldn't manipulate the frequency, ω, of the applied RF trapping voltage or some combination of ω, U and V to accomplish the same thing. While it is convenient from the standpoint of ion collection and detection to have specific mass selected ions become unstable in the axial direction, a three electrode trap operating according to the described principle could be operated so that mass selected ions would have unstable trajectories in the radial directions and reach a detector by transmitting through the ring electrode.

What is claimed is:

1. In the method of mass analyzing a sample which comprises the steps of defining a three-dimensional quadrupole field into which the sample is introduced and ionized whereby ions in the range of interest are formed and simultaneously trapped and the three-dimensional trapping field is varied so that ions of consecutive specific masses become sequentially unstable leave the trapping field and are detected to provide an indication of the trapped ion masses, the improvement comprising first ionizing sample introduced into the quadrupole field and then rapidly measuring the total ion content and using the total ion content information to control the number of sample ions formed in the ion trap to minimize saturation and space charge during analysis of the sample.

2. The method of mass analyzing a sample which comprises the steps of defining a three-dimensional quadrupole trapping field, introducing sample to be analyzed into said trapping field, projecting an ionizing beam into said trapping field to ionize the sample whereby ions are formed and trapped in said trapping field, rapidly measuring the total ions, again introducing sample to be analyzed into said trapping field, again projecting an ionizing beam into said trapping field to ionize the sample and form and trap ions in said trapping field, controlling the ionizing beam responsive to the total ion content measurement to control the number of ions formed so that the ion trap is not saturated or space charged, varying the trapping field so that trapped ions of consecutive specific masses become unstable and leave the trapping field, and detecting said ions to provide an indication of the trapped ions masses.

3. The method as in claim 2 in which the ionization beam is controlled by controlling its duration.

4. The method as in claim 2 in which the ionization beam is controlled by controlling its intensity.

5. The method as in claim 3 in which the ionization beam is an electron beam.

* * * * *

UNITED STATES PATENT AND TRADEMARK OFFICE

CERTIFICATE OF CORRECTION

PATENT NO. : 5,107,109

DATED : April 21, 1992

INVENTOR(S) : George C. Stafford Jr. et al.

It is certified that error appears in the above-identified patent and that said Letters Patent is hereby corrected as shown below:

Column 1, line 32, after "may" insert --be determined.--

Column 1, line 41, after "applied" insert --.--

Signed and Sealed this

Twenty-fourth Day of May, 1994

*Attest:*

Bruce Lehman

BRUCE LEHMAN

*Attesting Officer*

*Commissioner of Patents and Trademarks*